United States Patent [19]

Seki et al.

[11] 4,039,065

[45] Aug. 2, 1977

[54] THERMAL PRINTER

[75] Inventors: Mitsuaki Seki, Tokyo; Takayoshi Hanagata, Yokohama, both of Japan

[73] Assignee: Canon Kabushiki Kaisha, Tokyo, Japan

[21] Appl. No.: 745,639

[22] Filed: Nov. 29, 1976

Related U.S. Application Data

[63] Continuation of Ser. No. 569,610, April 21, 1975, abandoned, which is a continuation of Ser. No. 387,166, Aug. 9, 1973, abandoned.

[30] Foreign Application Priority Data

| | | |
|---|---|---|
| Aug. 15, 1972 | Japan | 47-81577 |
| Aug. 15, 1972 | Japan | 47-81578 |
| June 25, 1973 | Japan | 48-71891 |

[51] Int. Cl.[2] ..... B41J 3/20

[52] U.S. Cl. ..... 197/1 R; 197/82; 197/133 R; 346/76 R

[58] Field of Search ..... 197/1 R, 82, 84 R, 84 B, 197/133 R, 127, 144, 17, 114; 101/93.04, 93.05; 346/76 R; 219/216; 318/138, 254, 696

[56] References Cited

U.S. PATENT DOCUMENTS

| | | | |
|---|---|---|---|
| 2,454,966 | 11/1948 | Faus | 346/76 R X |
| 3,062,350 | 11/1962 | Demmel | 197/17 |
| 3,710,913 | 1/1973 | Brennan et al. | 346/76 X |
| 3,719,261 | 3/1973 | Heinzer et al. | 197/1 R |
| 3,771,634 | 11/1973 | Lamb | 197/1 R |
| 3,799,313 | 3/1974 | Shevik | 197/144 X |

*Primary Examiner*—Ralph T. Rader

*Attorney, Agent, or Firm*—Fitzpatrick, Cella, Harper & Scinto

[57] ABSTRACT

A thermal printer for impressing a recording medium with letters making use of a thermal head including a dot line type. The printer is able to perform impression at a state with the thermal head pressing the recording medium against a recording medium feed roller and even when the recording medium is fed by one line after completion of the impression, the recording medium may be fed in such a state that the thermal head is kept in contact under pressure with the feed roller. A preheat bias construction may be incorporated to reduce use of electric current.

10 Claims, 16 Drawing Figures

THERMAL PRINTER

This is a Continuation, of application Ser. No. 569,610, filed Apr. 21, 1975 now abandoned, which in turn is a Continuation application of Ser. No. 387,166, filed on Aug. 9, 1973 now abandoned.

BACKGROUND OF THE INVENTION

1. Field of the Invention

This invention relates to thermal printers for imprinting a recording medium with letters making use of a thermal head, and more particularly to a simple thermal printer in which the thermal head makes pressure contact with a recording medium on a feed roller, and even when the recording medium is advanced after completion of printing. Thus, the recording medium may be fed in such a state that it is pressed against the feed roller by the thermal head.

2. Description of the Prior Art

In conventional thermal printers, the recording medium is fed after the thermal head has been freed from the recording medium at the time of feeding the recording medium. Therefore, it has ben required to specifically provide a solenoid or the like for freeing the head, thus complicating its construction and wasting electric power.

SUMMARY OF THE INVENTION

It is therefore an object of this invention to provide an improved thermal printer which overcomes the disadvantages noted above with respect to conventional devices.

It is a further object of this invention to provide a thermal printer in which a thermal head is opposedly arranged to press a recording medium against a paper feed roller so as to obtain an accurate feed pitch of said recording medium.

It is another object of this invention to provide a thermal printer which can charge the recording medium in a simple and easy way.

It is yet another object of this invention to provide a thermal printer having a construction most suited to employ a dot line type thermal head.

BRIEF DESCRIPTION OF THE DRAWINGS

FI. 15 shows a poly-chromic color forming heat-sensitive recording medium comprising heat-sensitive layers I and II on base layer III.

DESCRIPTION OF THE PREFERRED EMBODIMENTS

Embodiments of the invention will now be described with reference to the accompanying drawings.

Figure 1:
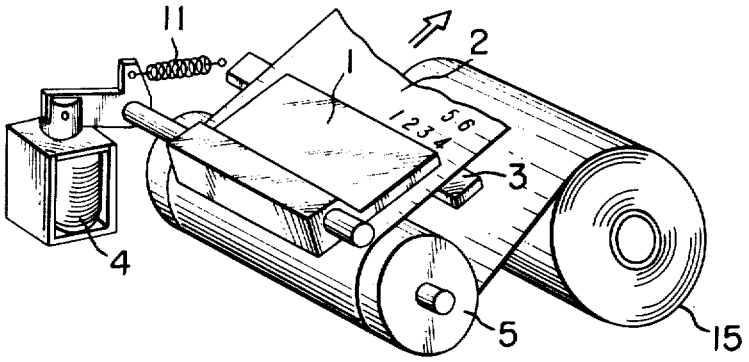
FIGS. 1, 2 and 3 show conventional thermal printers.
Figure 2:
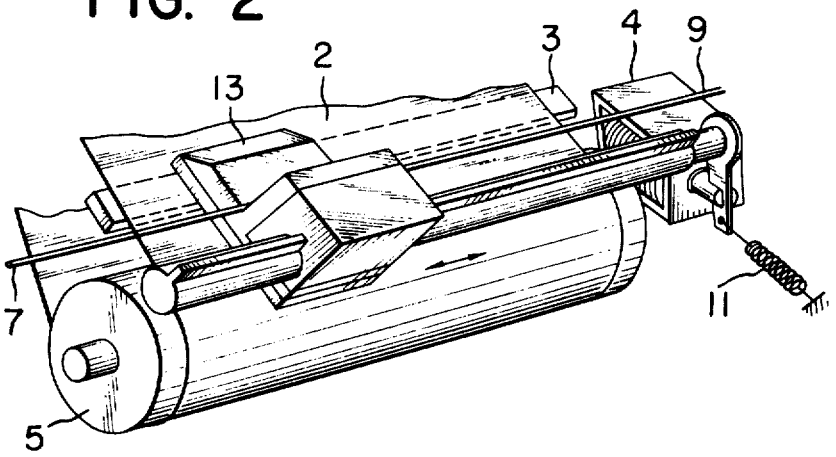
Figure 3:
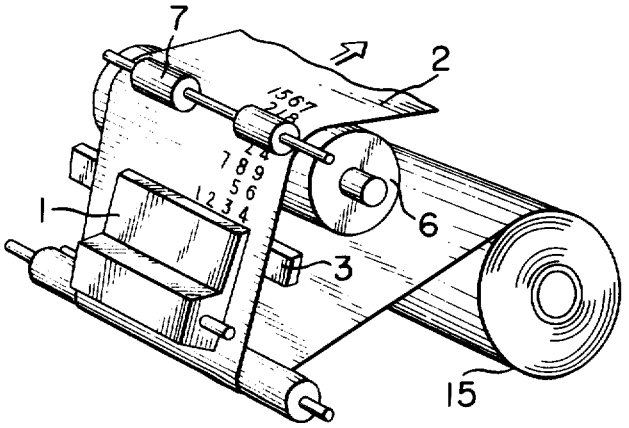

FIGS. 1, 2 and 3 illustrate conventional printers. Referring now to FIGS. 1 and 2, impression takes place, for example, in a state in which a thermal head 1 is made in contact under pressure with an elastic pad 3 such as rubber or felt through a recording medium 2 by means of a spring under a pressing force in the range from 500 g to 1 kg. When printing, the thermal head 1 is closely placed in contact with the recording medium 2 by an elastic force of the elastic pad 3, but when the recording medium is fed by one line after completion of the impression, a solenoid 4 must be driven to free the head 1 from the recording medium 2. The reason is that a recording medium feed roller 5 is so arranged as to feed the recording medium 2, and if the head 1 is kept in contact under pressure with the recording medium 2, the feed roller 5 is not able to feed the recording medium 2, thus producing such disadvantages as strains and disorders in impression pitches caused therefrom. As a method for solving such points, it has proposed that the recording medium 2 is pulled by a pull roller 6 as shown in FIG. 3. This method has, however, such disadvantages that it is difficult to load or remove the recording medium and furthr letters impressed become invisible by the provision of pinch rollers 7. Moreover, the entire device is inevitably designed to be a large type. One of such prior art devices is disclosed in U. S. Pat. No. 3,161,457 etc.

In view of the foregoing, this invention is to provide a small type printer which can impress letters in good order, eliminating the aforesaid disadvantages. One embodiment according to the invention is shown in FIG. 4.

Figure 4:
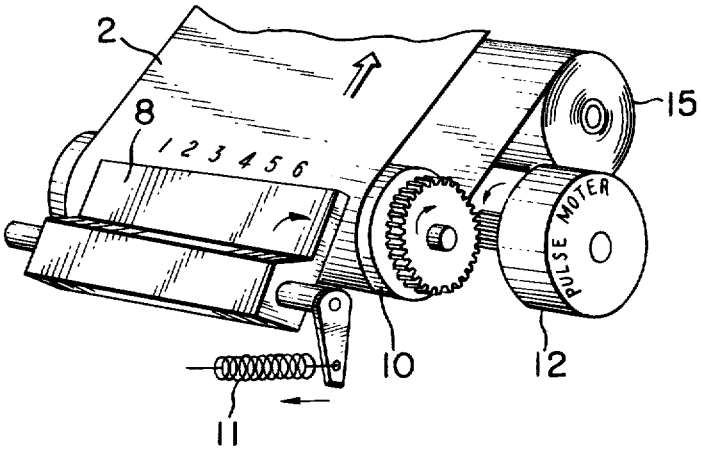
FIG. 4 shows an embodiment according to the present invention.

In FIG. 4, impression takes place in a state in which the recording medium is pressed against a feed roller 10 is made in contact under by a thermal head 8 wherein the pressure is exerted by a pressing spring 11. The feed roller 10 is intermittently rotated by means of a pulse motor 12 so that the recording medium 2 may intermittently be fed. The head 8 is kept in contact under pressure by means of the spring 11 both when impression is taken place and when the recording medium is fed. With the recent improvement of pulse motors, they have a powerful driving force if they are a small type so that the recording medium may sufficiently be fed in a state in which the head 8 is kept in contact under pressure with the recording medium 2.

Figure 5:
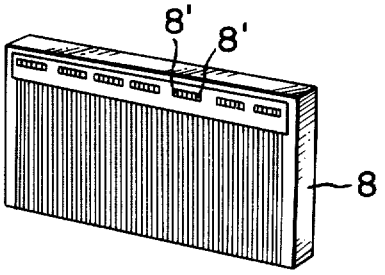
FIG. 5 shows one of thermal heads to be used in the invention.

Further, with the recent improvement of thermal heads, there are available inexpensive heads such as shown in FIG. 5 having characteristics such as rigidity, and long life.

Figure 6:
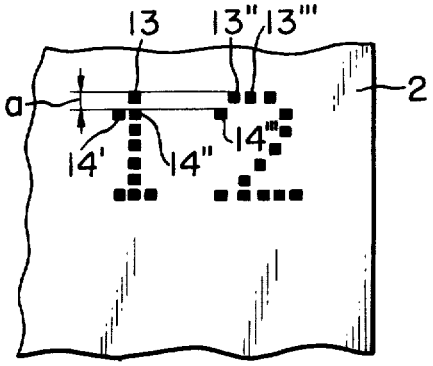
FIG. 6 shows one example of impression with the thermal head shown in FIG. 5 used.

The head as shown is different from a conventional type in which heat generating elements are disposed in a dot matrix. In the head of this invention there is provided only one line comprising five heat generating elements, and the recording medium is intermittently driven to form a dot matrix for one letter impression. FIG. 5 illustrates an example of a head in which a group of five one-letter forming heat generating elements are aligned in the number of letters required to form a line printer. In the event that such a head 8 is used as shown in FIG. 4, as seen from an illustration of impression shown in FIG. 6, a heat generating element 8' of the head 8 is first selectively urged to record marks such as 13', 13'' and 13''' on the recording medium 2, and the recording medium 2 is fed by a pitch *a* by means of a pulse motor 12, and thereafter the heat generating element 8' is again selectively urged to record marks such as 14', 14'' and 14'''. In the event that such a head 8 is used, a good contact area may be secured even by the feed roller 10 of a smaller diameter and a pressing force may be made smaller so as to be able to provide a device of a small type which can sufficiently be driven even by the pulse motor 12 of an extremely small type. Further, the spring 11 of a small type can also be used.

Figure 7:
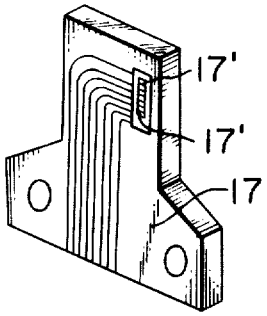
FIG. 7 shows another thermal head to be used in the invention.
Figure 8:
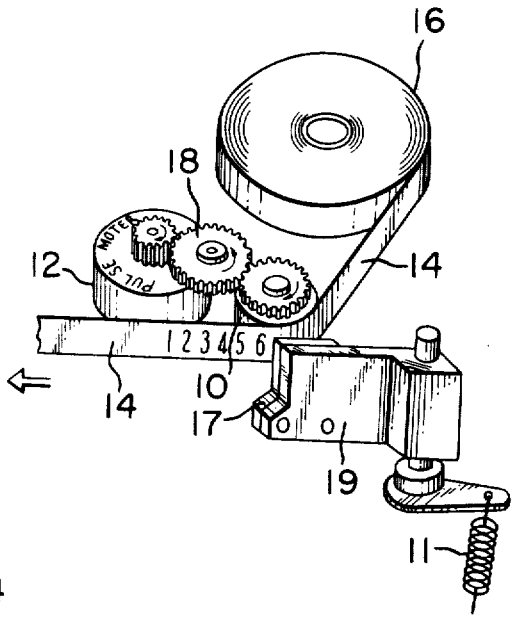
FIG. 8 shows another embodiment of the thermal printer using the thermal head shown in FIG. 7.
Figure 9:
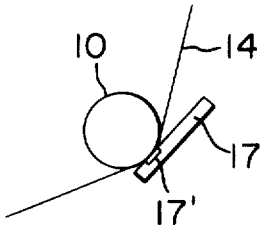
FIG. 9 is a sectional view showing an impressed portion thereof.

FIGS. 7 8 and 9 illustrate other embodiments, in which a feed roller 10 may intermittently be driven at a high speed by means of a pulse motor 12 while performing impression in a state in which a tape-like recording medium 14 is kept in contact under pressure with a head 17 by means of a spring 11, this device being most suitable for a small type typewriter, a printer for a counting machine, and the like. In the event that a dot line type thermal head 17 is used as shown in FIG. 9, an impression area of a dot line 17' is small so that a sufficient contact area of impression may be secured even if a roller has its small diameter.

Figure 10:
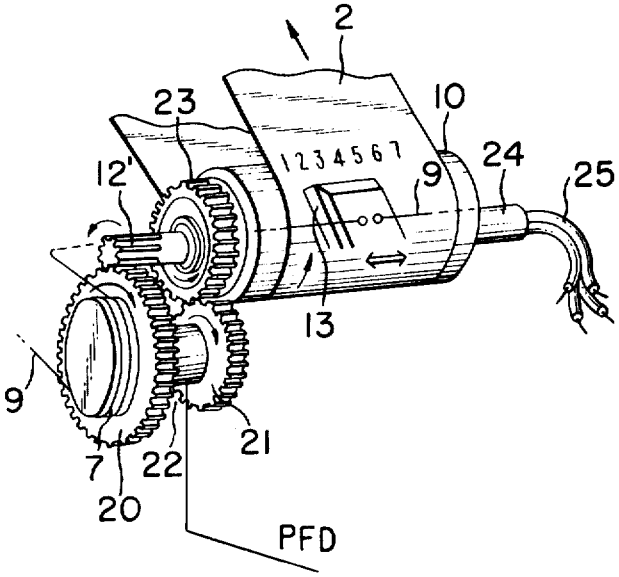
FIG. 10 shows still another embodiment of the thermal printer according to the invention.
Figure 12:
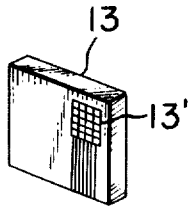
FIG. 12 shows a further embodiment of the invention.

FIG. 10 illustrates another embodiment of the invention, in which the device is designed to be small in type by encasing the pulse motor 12 as shown in FIG. 4 into the feed roller 10 so that the space thereof may jointly be used. A turning force of a shaft 12' for the pulse motor 12 is transmitted to a gear 20 to wind and unwind wires 7 and 9. In the mid-portion between the wires 7 and 9 there is mounted an impressing head 13 as shown in FIG. 12, and the head is moved as the motor rotates for the performance of one-line impressions.

Figure 11:
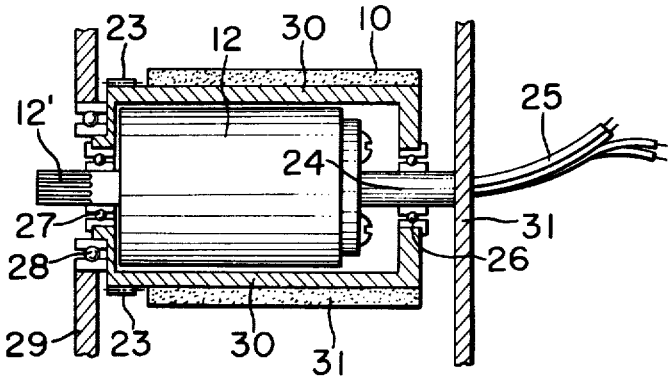
FIG. 11 is a longitudinal section of FIG. 10.

When the motor is rotated in a reverse direction, the gear 20 is rotated in a reverse direction as indicated by an arrow causing the wire 9 to be unwound to return the head to its original position. When an instruction signal PFD for feeding a recording medium enters an electromagnetic clutch 22, the shaft of the gear 20 is placed in engagement with the shaft of the gear 21 to rotate the gear 21. When the gear 21 is rotated, a gear 23 engaged therewith rotates. The gear 23 is secured to recording medium feed means 30 rotatably mounted outside the motor 12 as shown in FIG. 11 so that said means 30 is also rotated and the recording medium is fed by a frictional force of the rubber roller 10 mounted on said means 30 to effect paper feed. When the feed instruction signal PFD to the electromagnetic clutch 22 is cut off and, the clutch 22 is again released to disengage the gear 20 from the gear 21, stopping paper feed. A maximum height of a letter in one line may be determined by properly adjusting the width of said feed instruction signal PFD, and the order of one line impression, feeding, one line impression . . . may be determined systematically by setting timing of said signal to an appropriate time after completion of one line impression.

All the movable parts such as intermittent feed along the impression line of the impression head, feeding the recording medium as described above and the like, according to this printer, may be driven by one driving source, and these parts are arrangd inside the feed means 24 so that the entire device may be made small in type.

In FIG. 11, reference numerals 26, 27 and 28 designate bearings, the bearing 26 being mounted on a motor support shaft 24 and feed means 30 is smoothly and rotatably supported by said bearing 26. Bearing 27 is provided to smoothly rotate a rotational shaft 12' of the motor 12 and the feed means 30, and bearing 28 is provided to support the feed means 30 on the base 29 to provide a smooth rotation.

Figure 13:
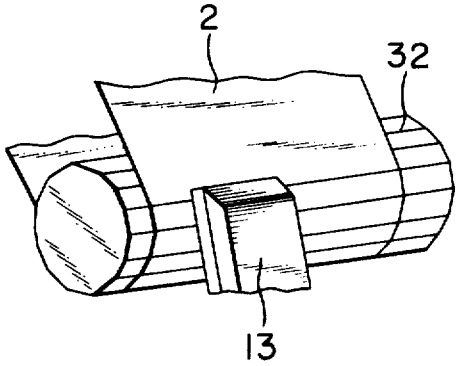
FIG. 13 shows another embodiment of feed means having a rubber roller.

According to the construction of the invention as shown in FIG. 10, the diameter of the rubber roller 10 is sufficient with respect to the impression contact area of the thermal head, and therefore the impression element causes the dot matrix like thermal head 13 to be placed in plane contact. Further, in this case, in order to keep better plane contact, feed means having a polygonal rubber roller 32 as shown in FIG. 13 is used. This polygonal feed means is manufactured by an integral technique, and therefore it has a substantially plane impressing surface, which is most suited to such a thermal head that is difficult to provide bend thereon.

Thermal heads of a dot line type as shown in FIGS. 5 and 8 are also suitable.

Figure 14:
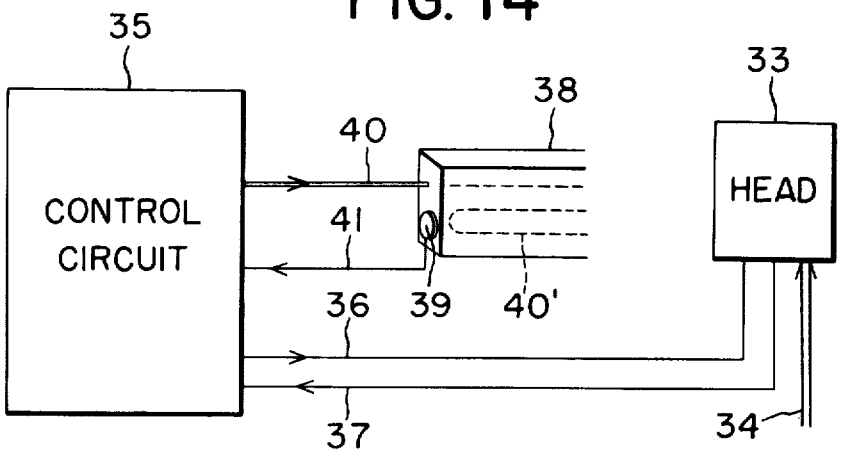
FIG. 14 shows another embodiment providing a heater for imparting heat to the heat-sensitive paper.

In an illustration shown in FIG. 11, when the motor 12 is rotated, some heat is generated. This heat is accummulated in the rubber roller 10 and is transmitted to the recording medium such as heat-sensitive paper, which can be heated to a lesser extent than that required for printing. Thus, if a preheating bias system is incorporated in the thermal printer, an impression drive current to be transmitted to the thermal head may be reduced to thereby prolong the life of the head. Further, it is possible to overcome indistinct impressions and limitations in a maximum impressing speed due to the delay of response of the recording medium, and the like. Or, as shown in FIG. 14, heat-sensitive paper or positive heat imparting means may be provided on the thermal head. In FIG. 14, reference numeral 33 denotes a thermal head, and various types of thermal heads other than those heads shown in previous embodiments may be employed. Numeral 34 is a conductor for flowing a driving current which selectively urges each heat generating element, and number 35 denotes a temperature control circuit for forming a preheating bias, which flows a preheating current for heating the thermal head 33 through a conductor 36. Various other means for preheating the thermal head 33 are considered. For example, a heat generating wire may be embedded or lined by way of an integral technique in the vicinity of the heating generating element of the head, or a current of one half or one third of a driving current for an ordinary impression may be conducted equally into each heat generated element. Reference numeral 37 is a control means which detects an existing temperature of the head 33 to feedback to the control circuit 35 and controlling the preheating driving current from the conductor 36. This will prevent an undesired impression with the head 33 excessively heated, and will be well responsive to a room temperature environment to always provide a continuous optimum impression. Reference numeral 38 indicates one example of heat imparting means for heating a heat-sensitive recording medium to such extent that color forming is not produced, which is made of an insulating material.

Figure 15:
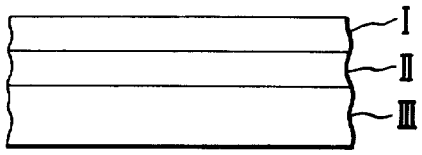
Figure 16:
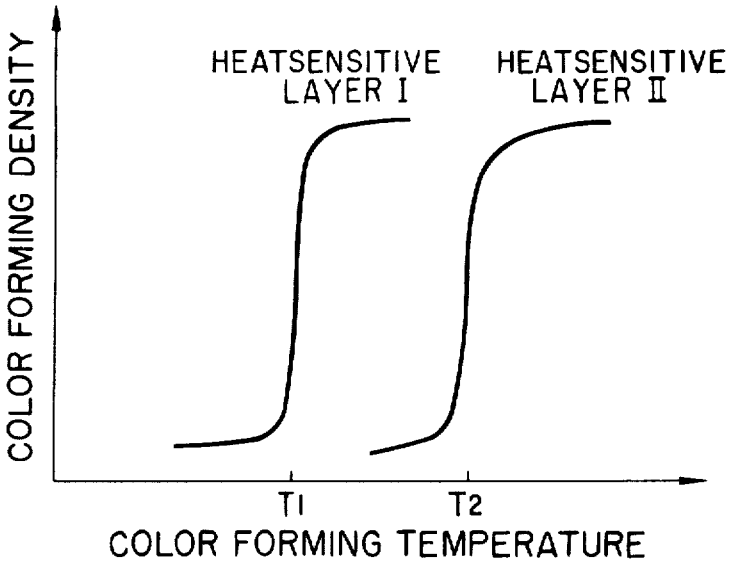
FIG. 16 shows the relationship between the color forming temperature and the color forming density with respect to the heat-sensitive layers I and II.

Lately, heat-sensitive recording mediums of good quality have been manufactured, wherein such mediums are not discolored even if a given heat is continuously applied. Consequently, the same effect as that described above may be obtained even by preheating the recording medium. Numeral 40 designates a conductor for flowing a preheating current and 41 the conductor for feeding back a detection current from a temperature detector 39 to a control circuit 35. Numeral 40' designates a heat generating wire. The insulating member 38 may well be disposed immediately before a position where impression takes place by the head 33. The optimum location is a position opposite to the head 33 through the recording medium. With such a preheating bias construction, a polychromic impression making use of a polychromic recording medium may easily be incorporated. That is to say, a polychromic impression on a polychromic color forming heat-sensitive recording medium, which comprises a heat-sensitive layer I which forms color at temperature $T_1$ and a heat-sensitive layer II which forms color at temperature $T_2$ each layer being mounted on a base material III, will be described with reference to FIG. 15. With the thermal head 33, the heat-sensitive layer I is used for an ordinary impression (for example, black) and the heat-sensitive layers II and I are used for color impression (for example, red). In this case, a color forming temperature of the heat-sensitive layer II is higher than that of the heat-sensitive layer I, and therefore it is required to increase the driving current for the head. As previously described, the thermal head has a limitation in its maximum allowable driving current, so that it is impossible to increase the current without limitation. In this case, a polychromic impression may be performed by applying an increased current from the control circuit 35 without adversely affecting the head 33. When the increased current is applied to the insulating member 38 or the head 33, the heat-sensitive layers I and II are made responsive, causing a mixed color in the heat-sensitive layers I and II. Accordingly, a color is formed which is different from that of said heat-sensitive layer I, thus attaining a favorable effect in use. The distinction and the high speed of the impression may favorably be influenced by heating the relatively high temperature heat-sensitive layer II from the base material III side.

As previously described, the driving current to the head may be substantially reduced according to said preheating construction so that polychromic impression may easily be performed only by controlling a current to the, without breaking the head by exceeding a maximum allowable current to the head is set to meet the heat-sensitive layer which forms color at a highest temperature.

It may alternatively be constructed so that a current flows from the control circuit 35 only in the case where a polychromic impression is performed without normally flowing a preheating bias current to the insulating member 38 or the head 33.

The control circuit 35 has also a function to discriminate and control impression patterns of various colors. For example, in the event that the printer of the invention is applied to a desk type electronic computer, various color formations may be controlled in such a way that impression is performed in black for ordinary figure converting processes such as operational figures, figures to be operated, or the like; impression is performed in green for operational results; impression is performed in red for over-flow; and impression is performed in blue for calling memories, and so on.

According to the illustration shown in FIG. 14, as previously described above, the printer making use of a thermal head is formed with a preheating bias construction to thereby reduce repetition of thermal stress due to the rapid variation of temperatures (variation in current), to prolong life of the impression head, to provide a high speed because impression can be made with less variation in temperature, and to provide distinctive impressions permitted by a gradual temperature gradient on the recording medium.

Also, if an embodiment as shown in FIG. 11 is employed, it is able to provide a printer which is small and simple in construction.

As described above, the thermal printer according to the present invention has various characteristics, which are summarized as follows.

1. The printer can be made smaller by not providing its with the elastic pad 3, the solenoid 4, and the like.

2. There is no disorder in paper feed pitch since the thermal head and the feed roller are opposedly placed in contact under pressure through the recording medium. Correct feeding in both forward and reverse directions can be effected and letters once impressed can easily be removed by the reverse feed.

3. To charge a recording medium, the recording medium is merely inserted between the feed roller and the thermal head, which is very simple.

4. Recorded letters are never hidden behind the pinch rollers.

5. By making use of a dot line type thermal head as shown in FIG. 7, a small-type pulse motor can be used to provide an extremely small type portable printer.

6. A preheating bias construction may readily be applied.

We claim:

1. A thermal printer comprising:

a cylindrical roller for receiving a sheet of recording medium around a portion of its circumference;

a thermal head having a plurality of dot elements to be selectively heated, said elements being arranged in a single line disposed in parallel with, and directed toward, the axis of said roller for contacting the recording medium to print selective dots on the medium;

a step motor coupled to transmit an intermittent turning force to the roller, to advance the recording medium to a next printing position after each heating of selective ones of said single line of dot elements, wherein characters are formed each having a plurality of dots formed by repetitive printing and advancing steps;

means for continuously pressing said single line of dot elements against the recording medium, at a position wherein the recording medium contacts said roller, by applying a force to said thermal head, directed toward the axis of said roller, while said dot elements are heated to print characters on the recording medium and while the recording medium is intermittently advanced, wherein said pressing force is maintained at a value sufficient to simultaneously print dots along the entire length of said single line of dot elements and to permit uniform advancement of the recording medium in response to the turning force applied to the roller by the step motor.

2. A thermal printer as defined in claim 1, wherein said cylindrical roller is hollow and said step motor is disposed within said roller.

3. A thermal printer as defined in claim 1, further comprising a heater disposed interiorly of said roller for heating said roller, wherein said printing of selective dots is carried out by heating the recording medium with said roller and heating said medium to a higher temperature by heating selective ones of said dot elements.

4. A thermal printer as defined in claim 1, in which said plurality of dot elements are arranged in spaced groups along said single line, wherein each said group is utilized to form separate juxtaposed characters.

5. A thermal printer comprising:

a polygonal roller having a plurality of resilient planar surfaces extending axially about its periphery for receiving a sheet of recording medium around a portion of said periphery;

a thermal head having a plurality of dot elements to be selectively heated, said elements being arranged in a plane disposed in parallel with the axis of said roller for contacting the recording medium to print selective dots on the medium wherein characters are formed by matrices of said dots;

a step motor coupled to transmit an intermittent turning force to the roller, to advance the recording medium to a next printing position after each heating of selective ones of said dot elements;

means for continuously pressing said dot elements against the recording medium, at a position wherein the medium contacts said roller, while said dot elements are heated to print characters on the recording medium and while the recording medium is intermittently advanced, wherein said pressing force is maintained at a value sufficient to simultaneously print the plurality of dots arranged in said plane and to permit uniform advancement of the recording medium in response to the turning force applied to the polygonal roller by the step motor.

6. A thermal printer as defined in claim 5, wherein said cylindrical roller is hollow and said step motor is disposed within said roller.

7. A thermal printer as defined in claim 5, further comprising a heater disposed within said polygonal roller, for heating the recording medium received on said roller, wherein said printing of selected dots is carried out by heating said medium with said roller and heating said medium to a higher temperature at selective positions by heating selective ones of said dots.

8. A thermal printer comprising:

a cylindrical roller for receiving a sheet of recording medium around a portion of its circumference;

a thermal head having a plurality of dot elements to be selectively heated, said elements being arranged in at least one line disposed perpendicular to the axis of said roller for contacting the recording medium to print selective dots on the medium, wherein the full length of said one line of elements has a length which is sufficiently short to press the medium against the roller in a planar disposition;

a step motor coupled to transmit an intermittent turning force to the roller, to advance the recording medium to a next printing position after characters are printed each having a plurality of dots formed by heating said elements; and means for continuously pressing said dot elements against the recording medium at a position wherein the recording medium contacts said roller, by applying a force to said thermal head directed toward the axis of said roller, while said dot elements are heated to print characters on the recording medium and while the recording medium is intermittently advanced, wherein said pressing force is continuously maintained at a value sufficient to print dots along the entire length of said line of dot elements and to permit uniform advancement of the recording medium in response to the turning force applied to the roller by the step motor.

9. A thermal printer as defined in claim 8, in which said plurality of dot elements are arranged in a dot matrix array, wherein one character is synthesized with said dot matrix, and the printing of the characters are performed one by one.

10. A thermal printer as defined in claim 8, wherein the printer further comprises means for moving said thermal head in the axial direction of the roller, and transmission means coupled to means for moving said thermal head for transferring the turning force of said step motor to intermittently drive said moving means.

* * * * *